United States Patent [19]

Hannon

[11] Patent Number: 4,919,413

[45] Date of Patent: Apr. 24, 1990

[54] NEWSPAPER HANDLING AND COLLATING METHOD AND APPARATUS

[75] Inventor: Charles N. Hannon, Olathe, Kans.

[73] Assignee: Stepper, Inc., Olathe, Kans.

[21] Appl. No.: 235,209

[22] Filed: Aug. 23, 1988

Related U.S. Application Data

[62] Division of Ser. No. 842,535, Mar. 31, 1986, abandoned.

[51] Int. Cl.[5] ..... B65H 3/46

[52] U.S. Cl. ..... 271/133; 271/137; 271/140; 271/144; 271/161; 271/165; 271/167; 271/171; 271/273

[58] Field of Search ..... 271/3.1, 42, 131, 133, 271/137, 138, 139, 140, 141, 142, 143, 144, 161, 165, 167, 188, 171, 207, 209, 272, 273, 4, 19, 132, 10; 221/236, 259, 262; 414/125, 131, 797.9

[56] References Cited

U.S. PATENT DOCUMENTS

| | | | |
|---|---|---|---|
| 999,009 | 7/1911 | Cleal et al. | 101/86 |
| 1,225,410 | 5/1917 | Clark | 271/135 |
| 2,375,296 | 5/1945 | Ford | 271/138 |
| 2,541,985 | 2/1951 | Chatterton | 271/133 X |
| 2,680,614 | 6/1954 | Gibson, Jr. | 271/140 X |
| 2,828,126 | 3/1958 | Labombarde | 271/132 X |
| 3,019,017 | 1/1962 | Brownsey | 271/141 |
| 3,734,488 | 5/1973 | Hannon et al. | 271/10 X |
| 4,557,472 | 12/1985 | Hannon | 271/138 |

*Primary Examiner*—Joseph J. Rolla
*Assistant Examiner*—Edward S. Ammeen
*Attorney, Agent, or Firm*—Hovey, Williams, Timmons & Collins

[57] ABSTRACT

Each interfaced loader and metering hopper combination of a newspaper assembling system includes improvements for producing ridges in the newspapers at various states where separation of the newspapers from one another is required. The ridges enhance separation by stiffening the newspaper and reducing the area of contact and thereby the friction between them. At the receiving region of the loader, an arrangement of parallel side and central conveyors, wherein the central one is at a higher level than the side conveyors, produces ridges when the newspapers in a stack are fanned back into a stream. A pair of superimposed center conveyors and inclined laterally located arms produce ridges in the newspapers as they are discharged one at a time from a discharge region of the loader into a receiving zone in the hopper. A single central elongated member movable between raised and lowered positions on a reciprocating plate in the hopper which supports and bottom-feeds the newspaper stack produces central ridges in the newspapers which promotes separation of the lowermost newspaper from those above it. Also, clamping rollers which are normally held open are timed to close and clamp the lateral sides of the lowermost newspaper leading portion once it is received between them. The rollers form a clamping nip below the level of the separating member so as to pull the side portions down and augment separation and withdrawal of the lowermost newspaper.

9 Claims, 9 Drawing Sheets

Fig. 19
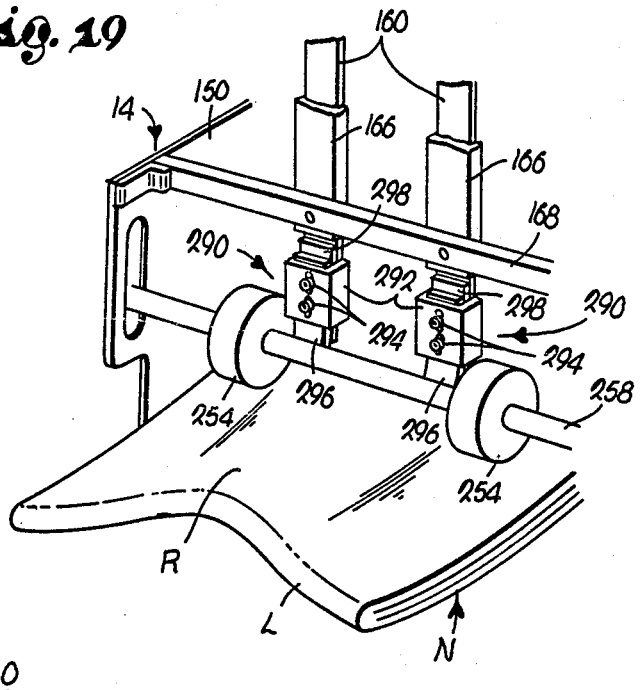
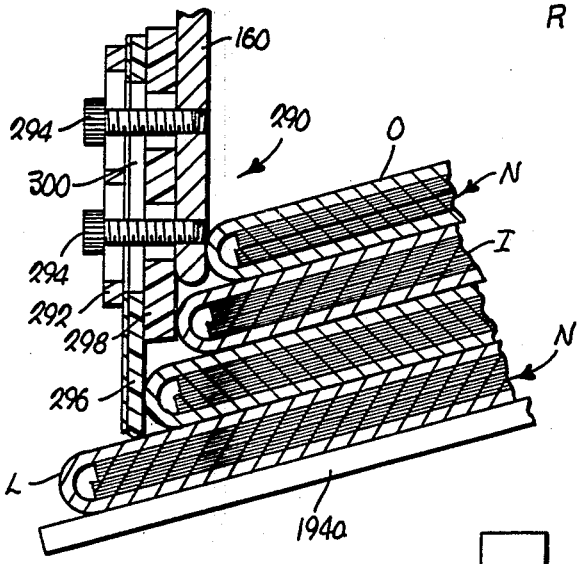
Fig. 20
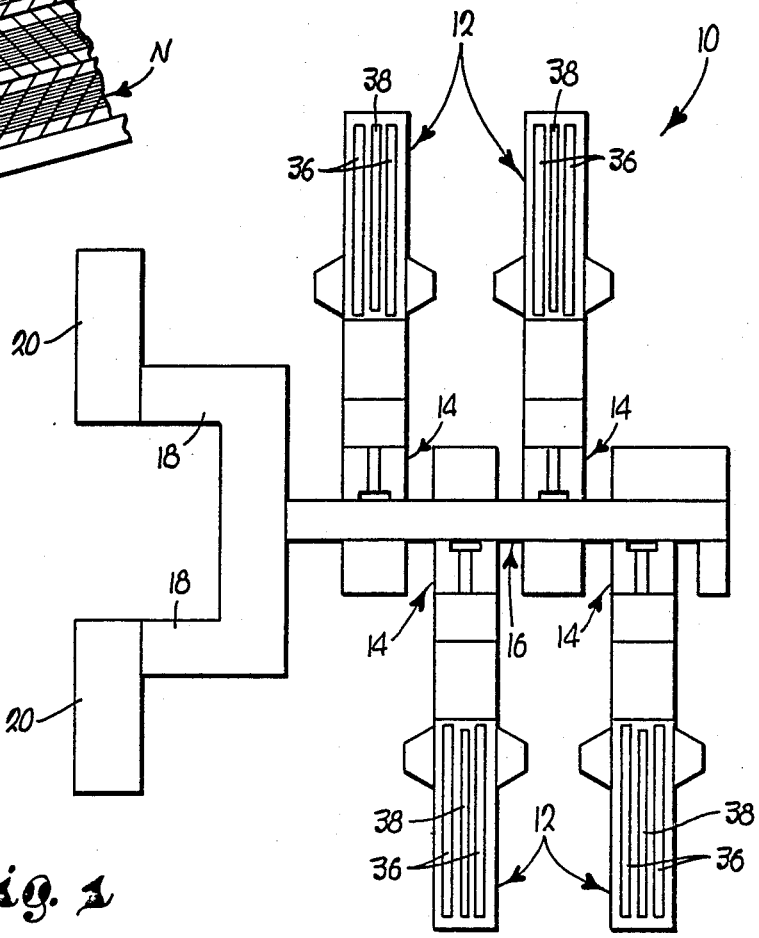
Fig. 1

Fig. 18
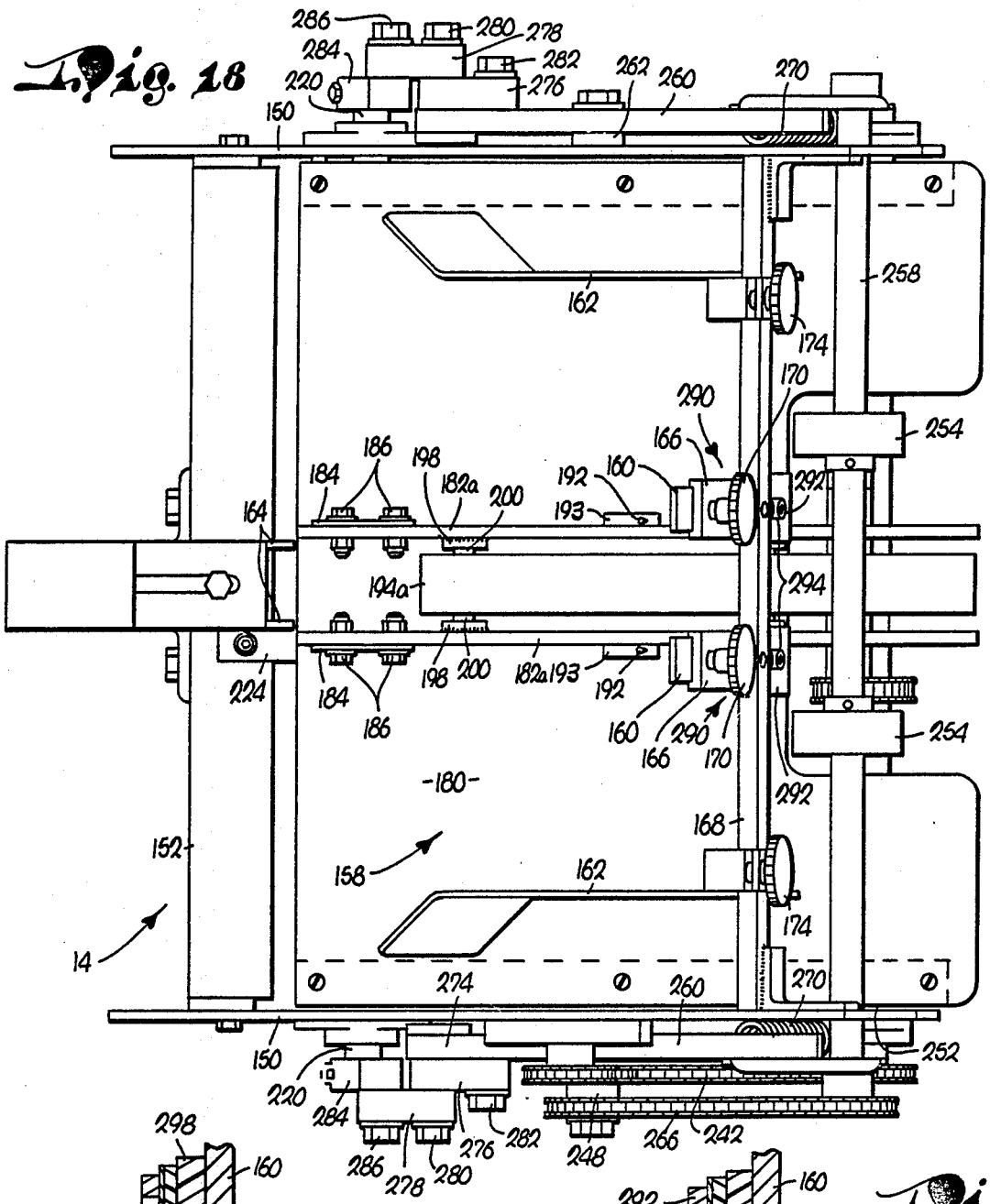
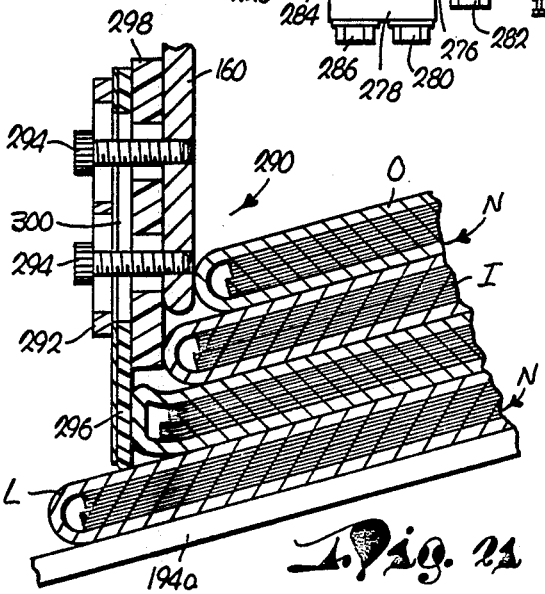
Fig. 21
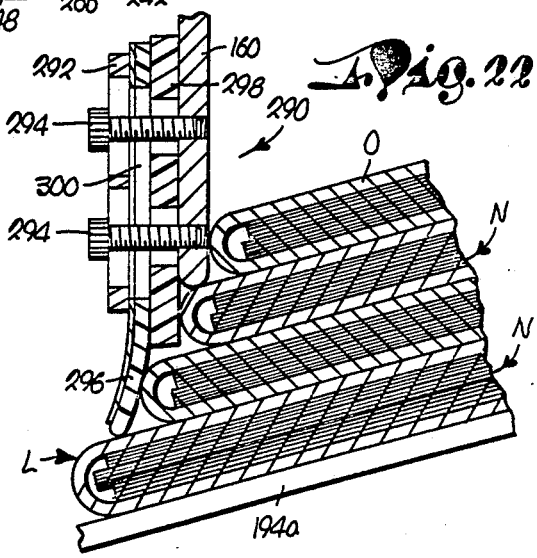
Fig. 22

NEWSPAPER HANDLING AND COLLATING METHOD AND APPARATUS

This is a division of application Ser. No. 842,535 filed on Mar. 31, 1986, now abandoned.

CROSS-REFERENCE TO RELATED APPLICATION

Reference is hereby made to the following U.S. patent application dealing with subject matter related to the present invention and assigned to the same assignee: "Multi-Purpose Feeder For Successively Delivering Single Sheet or Multi-Leaved Articles From A Stack Thereof" by Charles N. Hannon, assigned U.S. Ser. No. 801,279 and filed Nov. 25, 1985, a continuation of U.S. Ser. No. 431,556, filed Sept. 30, 1982, now U.S. Pat. No: 4,557,472, issued Dec. 10, 1985.

TECHNICAL FIELD

This invention generally relates to the field of machines for assembling multi-section newspapers and the like and, more particularly, concerns improvements in the loading and unloading of such newspapers into and from metering hoppers employed in the newspapers assembling line.

BACKGROUND ART

Most big city newspapers, especially the Sunday editions, are voluminous and bulky, being typically composed of a folded outer jacket and a side-by-side collection of other sections as well as numerous advertising and coupon inserts tucked within the outer jacket. With such size and makeup, they are floppy and hard to handle. However, timely delivery of large numbers of newspapers demands that automated equipment be utilized in assembling them.

To achieve the objective of timely delivery, the automated equipment commonly employs units, such as loaders, metering hoppers and conveyors, interfaced in an arrangement which allows automatic loading and collating of the parts of the newspapers in a rapid and systematic manner.

In one arrangement of automated equipment, multiple tandemly-arranged sets of loaders and metering hoppers feed different newspaper parts onto a common conveyor from which the different parts are collated into assembled newspapers. Each loader feeds newspaper parts one after another into its associated hopper wherein they form a stack and from which they are bottom fed seriatim onto the common conveyor. Typically, each loader has a bulk loading conveyor which permits newspaper parts to be loaded thereon in large stacks and then fanned back into a stream on the loading conveyor in which the trailing portion of each newspaper part is overlapped by the leading portion of the next succeeding one. The newspaper parts in the stream thereof are moved to a discharge location above the associated hopper where they are dropped into the hopper so as to form the stack therein. Each hopper employs a reciprocating device, such as disclosed in the application and patent cross-referenced above, which is operative, while supporting the stack in the hopper, to lift the stack slightly, form ridges in the lowermost newspaper part and concurrently feed it outwardly from under the stack.

As the number of inserts and thus the thicknesses and looseness of the newspaper parts continue to increase, the normal difficulties encountered in loading the parts into the hopper and feeding them from the hopper tend to increase, and, if not reduced, will result in more frequent misfeeding of parts which leads to jamming of the equipment and costly downtime. For example, when a stack of newspaper parts is placed on the bulk loading conveyor of the loader and fanned back by hand in preparation for feeding them in a stream to an associated hopper, sometimes the bottom side of the outer jacket fails to slide back with the rest of the jacket and instead "boils up" and rolls forward, allowing the sections and inserts of the newspaper part to spread out from one another and the outer newspaper jacket and causing a loose, enlarged loop at the fold line. Such loop then tends to be gripped by feeding mechanism downstream, instead of the insert-filled portion of the paper, pulling the jacket free from the inserts and causing jam-ups and misfeeds. Also, when the newspaper parts are fed from each loader to its associated hopper, they must be ejected outwardly from its discharge end a sufficient distance to clear it so that they can then properly drop downwardly on top of one another to form a neat stack within the hopper. As the thickness and looseness of the newspaper part increases, so does the tendency of its leading portion to droop and the part to thereby not eject from the loader at a proper attitude to ensure that it will remain intact on the stack. Further, in bottom feeding the lowermost newspaper part from the stack thereof in the hopper, sometimes just the outer jacket of the lowermost part is gripped by the clamping nip rollers and fed from the stack without the remainder of the newspaper part.

SUMMARY OF THE INVENTION

The preferred embodiment of the newspaper assembling equipment, as disclosed herein, includes several features which meet the aforementioned needs. While the present invention pertains to features which are particularly adapted for working together to facilitate the achievement of newspaper assembly in an improved manner, it is readily apparent that such features may be incorporated either singly or together in the same automoated equipment. Hereinafter, the term "newspaper" will be used for the sake of clarity with the understanding that such term also refers to parts of the newspaper which will be assembled together to form a complete newspaper.

One feature of the invention relates to improved newspaper loading at the receiving region of a transfer path defined by the loader which allows fanning of a stack of newspapers into a stream thereof without rolling of the leading end of the outer section away from the inner sections tucked therein. More particularly, the feature includes a pair of spaced side conveyors extending along the transfer path at the receiving region thereof and having respective conveying runs engaged with the newspapers and a central conveyor extending between side conveyors and having a conveying run engaged with the newspapers but disposed at a higher level than the conveying runs of the side conveyors so as to cause bending of the newspapers and formation of an elongated ridge in each one which extends centrally from a leading fold line to an opposite trailing extremity of the newspaper. The bending and ridge formation stiffens each newspaper and locks its inner sections stationary with respect to its outer section as the newspapers are fanned back from the stack thereof into stream form.

Another feature of the invention relates to improved newspaper unloading at the discharge region of loader transfer path which ensures that the newspapers being ejected from the discharge region tend to maintain a proper attitude for allowing travel through a distance sufficient to clear the loader so that the newspaper sections will remain together upon reaching their destination. More particularly, this feature includes a pair of spaced top and bottom center conveyors located at the discharge region of the transfer path and a pair of elongated depressing arms disposed along opposite sides of the center conveyors. The top conveyor has a lower conveying run and the bottom conveyor has an upper conveying run cooperable for engaging therebetween each newspaper along the center thereof and causing ejection of the newspapers from the discharge region of the transfer path. The arms are mounted so as to incline downwardly and forwardly to forwardmost ends disposed at a level generally below the lower conveying run of the top conveyor for engaging the newspapers along opposite lateral sides thereof and causing their deflection below the upper conveying run and thereby formation of an elongated ridge along the center of the newspaper. Also, a pair of guide surfaces are disposed along opposite sides of the center conveyors and below the respective elongated arms for limiting deflection of the opposite sides of the newspapers by the arms.

Still other features of the invention relate to improved bottom feeding of newspapers from the metering hopper which allow separation and movement of the lowermost newspaper without pulling its outer section away from the inner sections tucked therein. Such features include a single flat separator member movable from beneath the lowermost newspaper to form an elongated central ridge therein which extends from its fold line to its opposite extremity and thereby causes separation of the lowermost newspaper from the one above it. Also, upper and lower driven rollers are provided for gripping the leading portion of the lowermost newspaper to pull and eject it from the stack. The upper and lower rollers are normally displaced from one another in a separated relationship for receiving the leading portion of the lowermost newspaper therebetween before gripping it. Then the rollers are snapped together, clamping the leading edge of the newspaper therebetween at a point which is spaced below the upper surface of the single separator member to cause the ridging effect of the lower newspaper to be further exaggerated and accentuated, since there are two sets of the clamping rollers situated on opposite sides of the separator member in the area of the newspaper alongside of its ridge. The initial snap-clamping action in these strategic locations helps break loose the lower newspaper from the next above newspaper while the ridging effect is made more severe, and the bending down of the leading edge away from the next paper thereabove in itself is instrumental in encouraging clean separation. Instantaneous, jerking removal of the lowermost newspaper by the high-speed rollers further assists in this respect.

Furthermore, the metering hopper is provided with an inverse, stairstepped arrangement of depending retainer fingers adjacent the forward extremity of the hopper which causes the first few newspapers in the stack to be maintained in a corresponding stairstepped arrangement with one another such that each succeeding newspaper in the stack, up to a certain level, is set back slightly from the next one therebelow. This arrangement takes weight from the stack off the leading edges of the lower newspapers to free them up for most effective gripping by the nip rollers and separation from one another as the lowermost newspaper is withdrawn.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the drawings:

FIG. 1 is a top plan view of a newspaper assembling system which includes a plurality of interfaced loader/-hopper units, incorporating the improved features of the present invention, which feed a common cross conveyor;

FIG. 11 is a side elevational view, partly in section, of the metering hopper of FIG. 10 as seen with its side plate, linkage and drive arrangement being omitted to expose a reciprocable support structure of the hopper as well as its upper and lower clamping rollers in their respective initial, starting positions;

FIG. 18 is a top plan view of the hopper with the reciprocable support structure in the position seen in FIGS. 14, 16 and 17, but with the newspapers omitted;

FIG. 19 is a perspective view of a newspaper having a central ridge formed therein being ejected from the hopper by clamping rollers being engaged with the newspaper on opposite sides of the ridge therein; and FIGS. 20, 21 and 22 are enlarged fragmentary vertical cross-sectional views through a vertical midline of one of a pair of stops which prevent movement of all but the lowermost one of the newspapers with the feed stroke of the reciprocable support structure, showing a stairstep arrangement of flexible and rigid members on the lower end of the stop and their positions relative to the leading portions of the four lowest newspapers of the stack in the hopper at successive stages of ejecting the lowermost newspaper from the stack.

DETAILED DESCRIPTION OF THE INVENTION

Figures 2, 9:
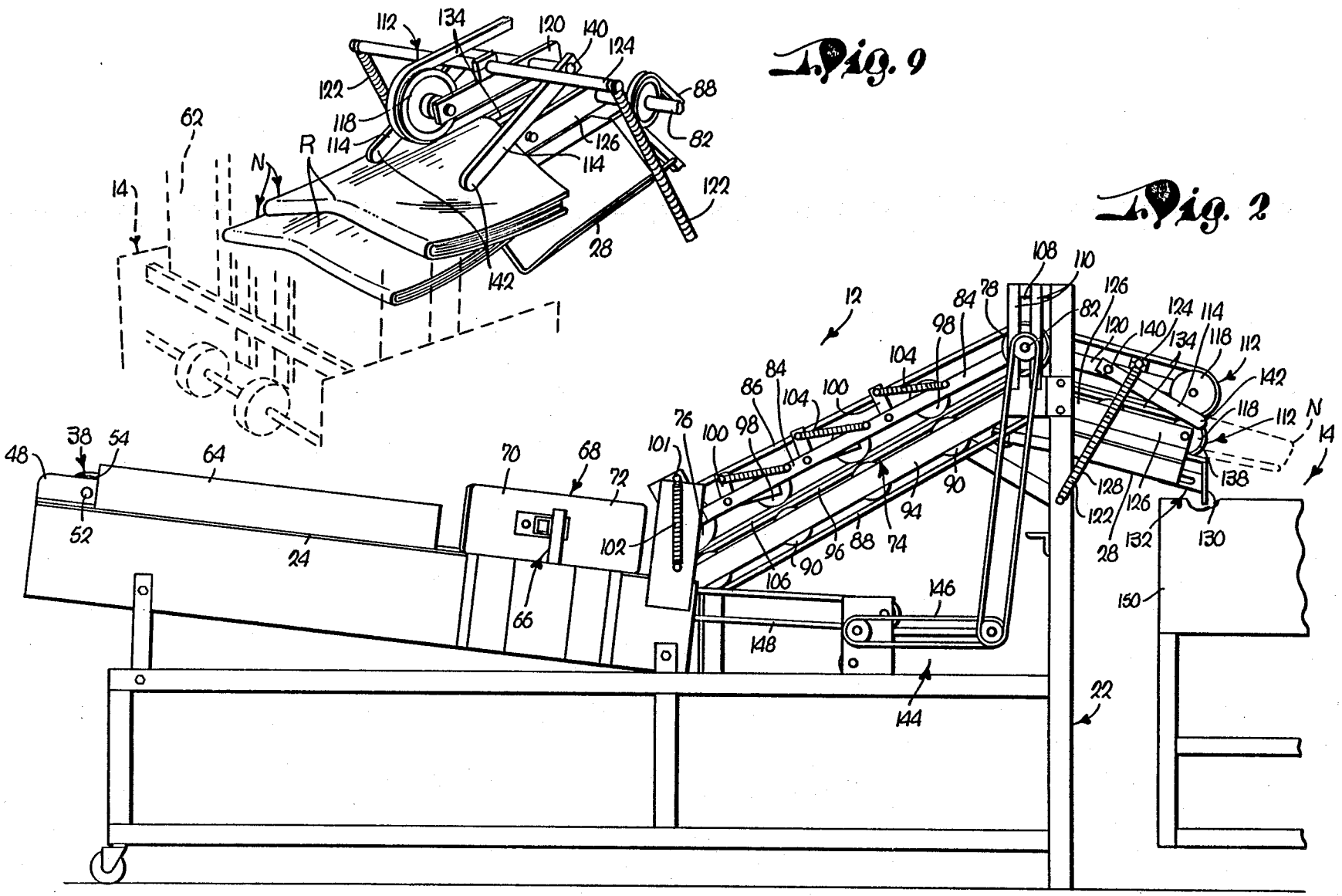
FIG. 2 is a side elevational view of one of the loaders of the system of FIG. 1.
FIG. 9 is a perspective view of the ridged newspapers being ejected from the discharge region of the loader of FIGS. 2–4.

Referring now to the drawings, and particularly to FIG. 1, there is shown, in simplified schematical form, a newspaper assembling system, generally designated 10, which employs multiple interfaced loaders 12 and metering hoppers 14 incorporating the improved features of the present invention. Different parts of newspapers are fed from the hoppers 14 onto a common cross-conveyor 16 where they are collated and assembled, and then diverted equally along different paths 18 to two different terminals 20 for final packaging and pickup for distribution.

Figure 3:
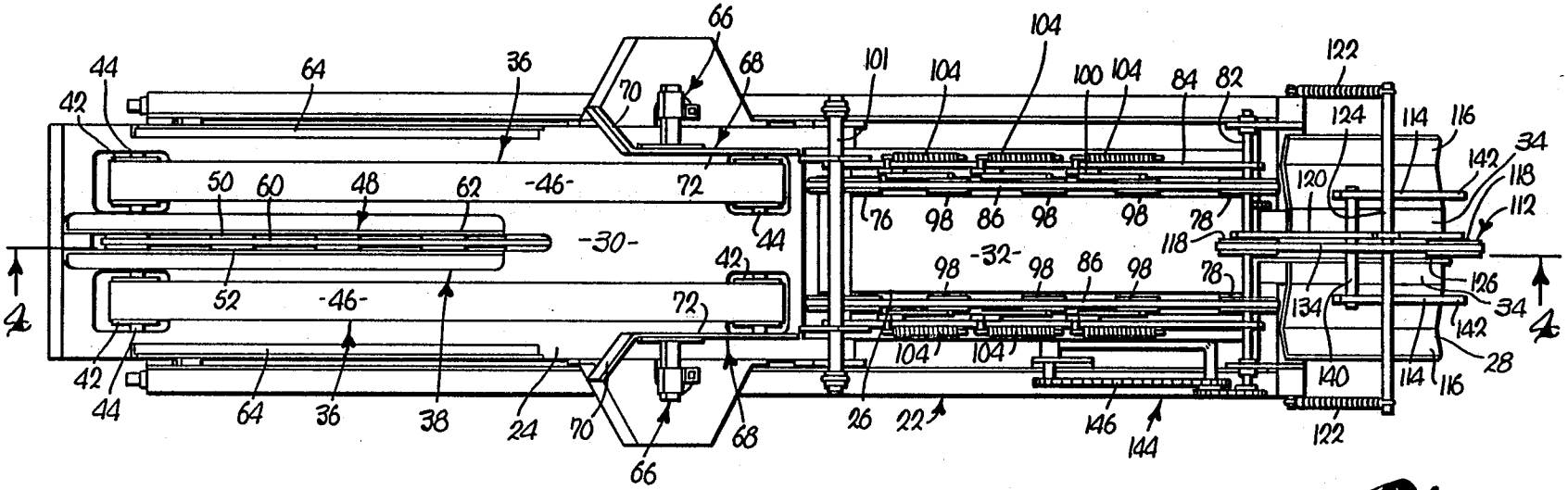
FIG. 3 is a top plan view of the loader of FIG. 2.
Figures 4, 5, 7:
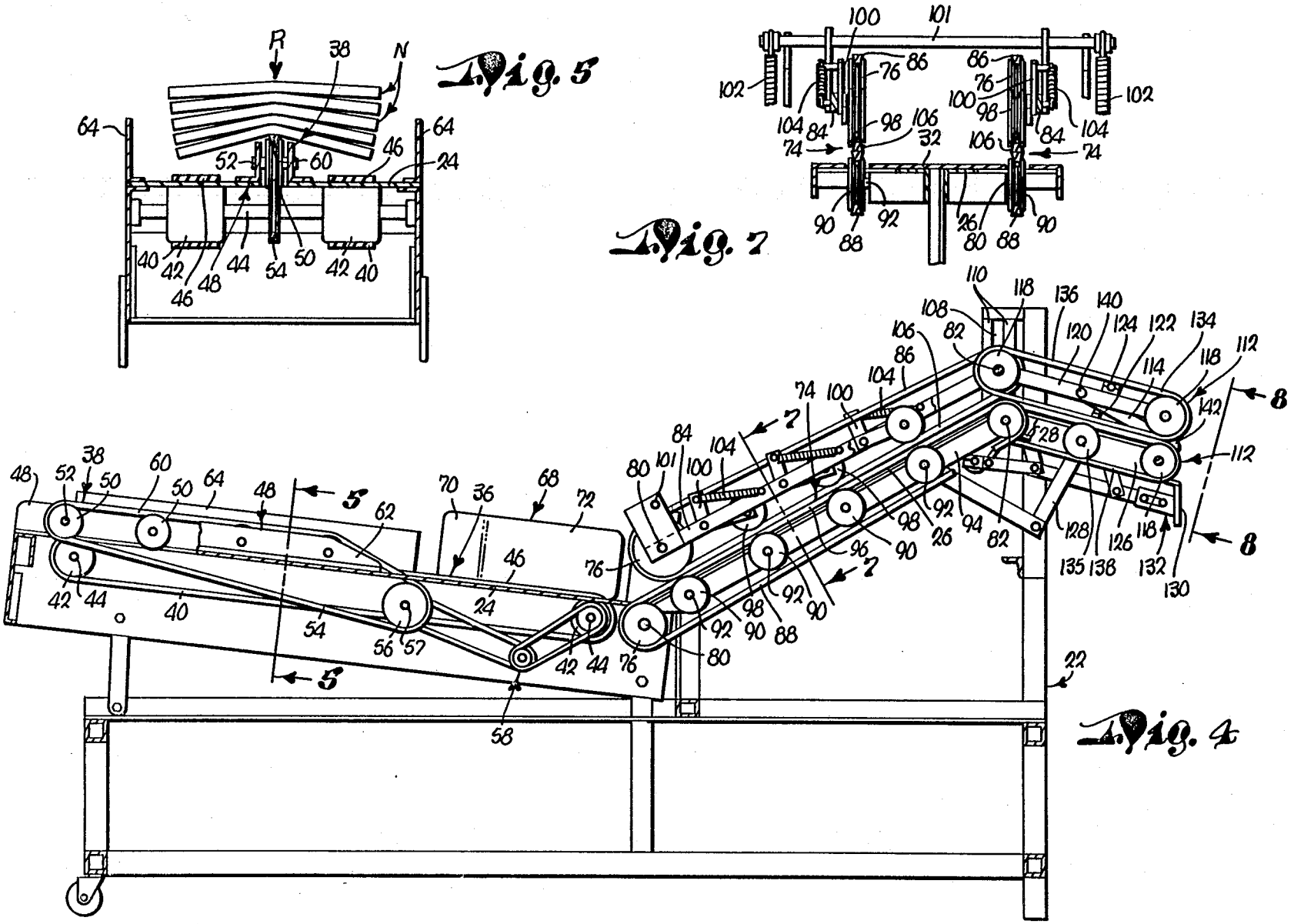
FIG. 4 is a longitudinal vertical, cross-sectional view of the loader as taken substantially along line 4—4 of FIG. 3.
FIG. 5 is a transverse vertical, cross-sectional view of the loader at its newspaper receiving region as taken along line 5—5 of FIG. 4.
FIG. 7 is a transverse vertical, cross-sectional view of the loader at its transfer region as taken along line 7—7 of FIG. 4.

One of the loaders 12 of the system 10 is shown in FIGS. 2 to 4. The loader 12 includes a frame 22 which mounts rear, middle and front support plates 24, 26 and 28 along the top thereof having respective upper supporting surfaces 30, 32 and 34 which define a newspaper transfer path. The transfer path includes receiving, transfer and discharge regions which are generally co-extensive with the rear, middle and front support plates 24, 26 and 28.

More particularly, the rear support plate 24, defining the newspaper receiving region at one end of the path, slopes forwardly and downwardly at a shallow angle, for example fifteen to twenty degrees, relative to the horizontal plane. Such inclination assists in preventing inner sections from slipping out of the newspaper outer section as it is conveyed from the newspaper receiving to transfer regions of the transfer path. The middle support plate 26, defining the newspaper transfer region of the path, slopes forwardly and upwardly at a relatively steep angle, for example thirty to forty degrees, relative to the horizontal plane. Such inclination is sufficient to elevate the newspaper along the middle supporting surface 32 from the newspaper transfer to discharge regions of the transfer path. At the discharge region, the newspaper is disposed above and to one side of the metering hopper 14 interfaced with the loader 12, as seen in FIG. 2, for ejection into the hopper. The front support plate 28, being one of the improved features of the present invention, will be discussed in greater detail later.

Figure 6:
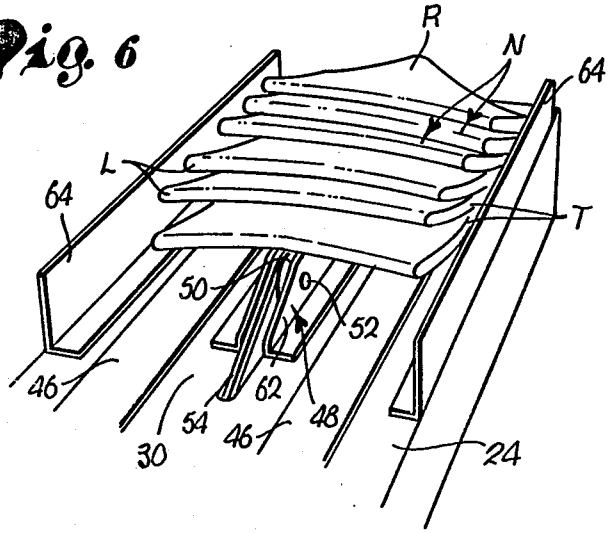
FIG. 6 is a perspective view of a stream of newspapers disposed in a back-fanned relationship along the receiving region of the loader of FIGS. 2–4.

At the newspaper receiving region of the transfer path being generally defined by the rear support plate 24, improved features are provided for allowing a stack of newspapers placed on the left half of the plate 24 to be manually fanned back into a stream of newspapers N, as seen in FIG. 6, without causing the fold line of an outer section O (See FIGS. 20 to 22) at a leading portion L of the newspaper N to roll upward and then rearward relative to its multiple inner sections I (see again FIGS. 20 to 22) tucked in the outer section. In the fanned stream, a trailing portion T of each newspaper N is overlapped by the leading portion L of the next succeeding newspaper N.

More particularly, a pair of spaced side conveyors 36 and a central conveyor 38 are mounted on the frame 22 so as to extend generally parallel to one another along the rear support plate 24. Referring particularly to FIGS. 3 to 5, each of the side conveyors 36 includes a wide flat endless flexible belt 40 entrained about a pair of rollerlike pulleys 42 secured on shafts 44. The shafts 44 extend in transverse relation across the frame 22 and are rotatably mounted to it generally adjacent to and below opposite ends of the rear support plate 24 such that an upper conveying run 46 of each conveyor belt 40 extends along and is supported by the upper supporting surface 30 of the rear plate. The forward, or right, one of the shafts 44 in FIG. 4 is the driven shaft, whereas the rear, or left, one is an idler shaft.

In contrast to the position of the side conveyors 36 generally below the rear support plate 24, the central conveyor 38 is positioned generally above the rear plate. The central conveyor 38 includes a pair of laterally spaced upright brackets 48 fixedly attached to the rear support plate 24 on its upper surface 30 and extending generally centrally along the plate for about two-thirds of its length from its rear end. A series of idler sheaves 50 are rotatably mounted on stub shafts 52 which extend between and are spaced for-and-aft along the brackets 48. A narrow endless flexible belt 54 is supported by the upper sides of the forward three idler sheaves 50 and is back wrapped about the rearmost sheave 50 and front wrapped about a sheave 56. The sheave 56 is secured to a shaft 57 which extends transversely across the frame 22 and is rotatably mounted to it below the rear support plate 24. The shaft 57 is driven from the forward driven one of the side conveyor shafts 44 via an intermediate motion transmitting train, generally indicated at 58.

With the central conveyor 38 positioned above the rear plate 24, an upper conveying run 60 of its belt 54 is at a level spaced above the rear plate and also the upper conveying runs 46 of the side conveyor belts 40. Because of this elevated positional relationship of the central conveyor 38 relative to the side conveyors 36, when a stack of newspapers N is placed astradle the conveyors 36 and 38 as seen in FIG. 5, the lateral sides of several lowermost ones bend downwardly. Then, as the stack of newspapers N is fanned backed into a stream thereof along the receiving region of the loader transfer path as shown in FIG. 6, the bending and resulting formation of a central ridge R in each newspaper becomes more pronounced the closer it gets to the bottom of the stack so as to cause a stiffening effect in the newspaper which augments sliding of each of the newspapers relative to one another without their outer section rolling away from the associated inner sections. This also locks inserts, coupons, and advertisements, which are frequently relatively slick-finished and easily slidable against one another into place within the newspaper and prevents their slipping out.

The central conveyor 38 does not extend the full length of the rear support plate 24 of the loader 12 since its purpose is limited to facilitating fanning of the newspapers N into a stream without allowing loosening and spreading out its contents. Thus, as the newspapers are conveyed forwardly or towards the right in FIGS. 2 to 4, they successively move down the foward tapered ends 62 of the central conveyor brackets 48 and assume a relatively flat condition on the side conveyors 36 and the rear plate upper supporting surface 30 with the trailing portion of each newspaper still being overlapped by the leading portion of the next succeeding one.

A pair of upright side panels or rails 64 are attached along the opposite lateral sides of the rear support plate 24 of the hopper 12 which assist in generally aligning the newspapers with one another as they are fanned back in the stream thereof and in keeping them aligned as they move toward the steeply inclined middle support plate 26 of the loader. Also, a pair of adjustable guides devices 66 are disposed on the loader 12 at the right exit end of the rear support plate 24 and side conveyors 36. The guide devices 66 include a pair of vertical guide plates 68 have converging rear lead-in portions 70 merging into generally parallel front portions 72 which function to laterally consolidate the newspaper stream into one having a tighter alignment than before so as to facilitate transport of the newspapers N up the inclined middle support plate 26 and deposit of the newspapers into the hopper 14 from the discharge region of the loader transfer path.

At the newspaper transfer region of the transfer path being generally defined by the middle support plate 26, the overlapping newspaper stream is transported upwardly and forwardly therealong between laterally-spaced pairs of conveyors 74 toward the discharge region of the path above the hopper 14. Each conveyor 74 includes upper and lower conveying portions composed of pairs of rotatable rear and front sheaves 76 and 78 disposed on shafts 80 and 82. The lower rear and front shafts 80 and 82 are rotatably mounted to the frame 22 generally adjacent the rear and front of the middle plate 26. The upper rear and front shafts 80 and 82 are mounted to opposite ends of a pair of elongated bars 84. The upper and lower conveying portions of conveyors 74 also include upper and lower endless flexible belts 86 and 88 being entrained above the sheaves 76 and 78.

A series of spaced idler sheaves 90 are rotatably mounted by stub shafts 92 to inclined support members 94 of the frame 22 between the lower rear and front sheaves 76 and 78 of each pair thereof for supporting an upper conveying run 96 of the one lower belt 88 entrained thereabout. Another series of spaced idler sheaves 98 are rotatably mounted on the lower forward ends of a corresponding number of L-shaped arms 100 being pivotally mounted on the elongated bars 84 which also mount the upper rear and front shafts 80 and 82. The idler sheaves 98 are thus positioned between the upper rear and front sheaves 76 and 78 of each pair thereof.

The lower ends of the bars 84 are yieldably biased downwardly by a cross bar 101 connected to springs 102 attached to the frame 22. Also, the arms 100 are yieldably biased by springs 104 attached to the upper rear ends of the arms 100 to pivot clockwise, as seen in FIG. 4, and cause their respective idler sheaves 98 to bear down on a lower conveying run 106 of the one upper belt 86 entrained about the upper rear and front sheaves 76 and 78 so as to exert sufficient force upon the upper conveying run 96 of the lower belt 88 to clamp and convey the newspapers therebetween. The opposite ends of the upper front shaft 80 is mounted for vertical sliding movement in a vertical guide slot 108 defined between parallel rails 110 attached to the frame 22. In such arrangement, the upper conveying portions of the conveyors 74 are vertically yieldable relative to the lower conveying portions for accommodating the varying thickness of the newspapers N as they enter between the upper and lower flexible conveying belts 86 and 88 of the conveyor 74.

At the newspaper discharge region of the transfer path of the loader 12, improved features are provided for again bending the newspapers immediately precedent to ejecting them into the hopper 14. In bending the newspapers, as seen most clearly in FIG. 9, a central ridge R is again formed in each newspaper N which stiffens it so that it juts out horizontally in a self-sustaining manner as it is ejected instead of drooping down by gravity as its leading portions become unsupported. This assures the newspapers will project out from the loader a sufficient distance to clear the components of the loader 12 and drop essentially straight down into the hopper 14 in a flat condition.

More particularly, the bending and formation of the central ridge R in each newspaper N at the discharge region of the loader path is carried out by top and bottom center conveyors 112 coacting with a pair of elongated arms 114 disposed on opposite sides of the conveyors 112. Also, the front support plate 28, mentioned earlier, takes the form of a pair of V-shaped guide surfaces 116 (FIG. 8) being disposed below the arms 114. Each of the center conveyors 112 includes rear and front sheaves 118. The rear sheaves 118 are rotatably mounted respectively on the front upper and lower shafts 82, which also mounts front upper and lower sheaves 78 of middle conveyors 74. The top front sheave 118 is rotatably mounted on the front end of an elongated lever 120 being pivotally mounted at its rear end to the front upper shaft 82. The elongated lever 120 is biased in a downard direction by a pair of springs 122. The springs 122 are disposed at the outer sides of the frame 22 and interconnect the frame and opposite outer ends of a rod 124 rigidly attached to the lever near its forward end and extending in transverse relationship to it.

Figure 8:
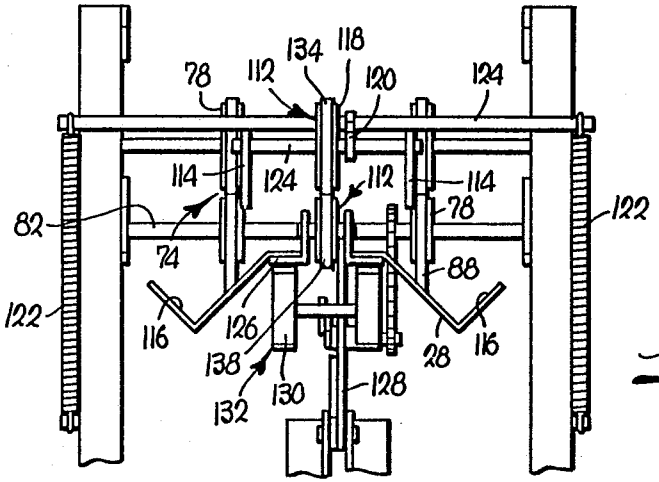
FIG. 8 is an end elevational view of the loader at its discharge end as seen along line 8—8 of FIG. 4.

The bottom front sheave 118 is rotatably mounted between a pair of parallel-extending angle braces 126 journalled at their rear ends to the front lower shaft 82. The braces 126 are also supported on the frame 22 via a link 128. As seen in FIG. 8, the opposite halves of the front plate 28 having the V-shaped guide surfaces 116 are attached to the braces 126 and extend laterally therefrom. A pair of guide bars 130 are disposed forwardly of the front plate 28 by an an adjustable linkage 132 supported by the frame 22. The guide bars 130 assist in guiding the ejected newspapers into the hopper 14.

Upper and lower endless flexible conveyor belts 134 are entrained about the rear and front sheaves 118 of the top and bottom center conveyors 112. A middle idler sheave 135 rotatably mounted between angle braces 126 supports a lower conveying run 136 of the top center conveyor 112. The lower conveying run 136 of the top conveyor 112, due to the biasing imposed by the springs 122 on the lever 120, cooperates with an upper conveying run 138 of the bottom conveyor 112 to engage between them successive newsapers N in the stream thereof along centerlines thereof and cause ejection of the newspapers from the transfer path at its discharge region. In view of the yieldable mounting arrangement of the upper one of the center conveyors 112 relative to the lower one, newspapers of varying or uneven thicknesses are accommodated between the conveying runs 134 and 136.

As the newspapers are moved toward their ejection point, bending and formation of the ridge R in the newspapers, as seen in FIG. 9, is positively effected by the elongated arms 114 which, being disposed along opposite sides of the center conveyors 112, are mounted at their rear ends by a cross shaft 140 which is connected to and extends outwardly from the lever 120 of the upper one of the center conveyors. The arms 114 are thus mounted at their rear ends at a level generally above the lower conveying run 136 of the top center conveyor 112 and extend in inclined fashion downwardly and forwardly to forward ends 142 disposed at a level generally below the lower conveying run. The inclined arms 114 are thus positioned to engage the newspapers along opposite lateral sides thereof and cause deflection of the newspaper sides below the upper conveying run 138 of the bottom conveyor 112. In so doing, the elongated ridge R is formed along the center of each newspaper N between the conveying runs 136 and 138. The V-shaped guide surfaces 116 of the front plate 28 disposed below the arms 114 serve to limit deflection of the opposite newspaper sides as well as support the deflected portions.

Rotary power is transmitted to the various conveyors 36, 38, 74 and 112 via a drive transmitting train, generally indicated as 144 (FIG. 2), made up of conventional drive chains and sprockets. The drive train 144 includes an articulated elbow-like drive portion 146 extending forwardly and upwardly which accommodates vertical yielding movement of the upper ones of the middle conveyors 74 and the top one of the center conveyors 112 relative to the respective lower ones of the conveyors. Also, the drive train 144 includes a non-articulated drive portion 148 extending rearwardly which is coupled with the lower end of the lower ones of the middle conveyors 74. The lower middle conveyors 74, in turn, transmit drive to the side and central conveyors 36 and 38 and the lower one of the center conveyors 112.

One of the metering hoppers 14 of the system 10 is shown in FIGS. 10 to 12 and 18. The hopper 14 includes a pair of upright side plates 150 which are structurally interconnected by a rear transverse angle beam 152 and a front transverse bar 154 situated below a reciprocating feeder device 156 located between the two sides plates. An upright newspaper receiving zone, generally designated as 158, is defined in the hopper 14 above the feeder device 156 by a series of spaced, variously adjustable, upright front retainers 160, upright side retainers 162, and a rear retainer 164, all of which are shown in FIG. 18. The front retainers 160 are vertically, slidably carried by respective brackets 166 which, in turn, are attached upon a transverse retainer bar 168 spanning the two side plates 150. Setscrews 170 associated with the corresponding brackets 166 releasably hold the corresponding front retainers 160 in selected vertical positions of adjustment. The side retainers 162 serve as the lateral confining means for the newspapers N contained within the zone 158. Such retainers 162 are carried by corresponding brackets 172 which are held in selected positions of adjustment along the retainer bar 168 by setscrews 174. The rear retainer 164, whose primary purpose is to assist in proper positioning of the lowermost newspaper for unloading from the hopper zone 158, is supported upon a rear bracket 176 attached to and extending upwardly from the rear transverse angle beam 152.

The feeder device 156 is supported for its fore-and-aft reciprocating movement by a set of four rollers 178 located essentially at the four corners of the device 156, rotatably mounted to the opposite side plates 150 and disposed to provide a downwardly and forwardly inclined attitude for the device. A support structure in the form of a plate 180 rides on top of the rollers 178 and provides a mounting surface for numerous structures, to be described, which function to engage and feed the newspapers during hopper operation. To this end, a pair of relatively thin, upstanding rails 182 are affixed to the support plate 180 with their longitudinal axes extending in the direction of feed and located in spaced apart relationship to opposite sides of a fore-and-aft centerline of the hopper 14. The rails 182 (being located closer together than those of above-cited patent) extend the full fore-and-aft length of the support plate 180 and present uppermost, newspaper supporting edges **182*a***.

A pair of pushers 184 are associated with respective ones of the pair of rails 182 and are located generally adjacent the rear ends thereof. The pushers 184 are in the form of relatively small, rectangular plates affixed to the outer faces of the respective rails 182 by releasable fasteners 186 which project through corresponding, elongated slots 188 in the rails. The slots 188 extend in fore-and-aft directions in parallel relationship to the support 180 plate to enable the pushers 184 to be adjusted fore and aft of the rails 182 upon loosening of the fasteners 186 thereof. Such loosening of the fasteners 186 also permits the pushers 184 to be adjustably positioned vertically due to slots 190 in the pushers through which the fasteners also pass. Further, a pair of pivotally mounted, spring-loaded, forwardly-tilted gripping pins 192 are attached to the outboard sides of each of the rails 182 intermediately between their opposite ends. Each pin 192 is mounted on a transverse pivot 193 and is yieldably biased by spring means (not shown) toward the position illustrated in FIGS. 11 and 14 whereby to slightly impale the lowermost newspaper during forward feed and facilitate such feeding thereof. Upon retraction of the feeder device 156, the pins 192 are rocked down clockwise about pivots 193 by the stationary next newspaper in the stack and have no effect.

Also, supported by the plate 180 and forming a part of the reciprocating feeder device 156 is a single separating and feeding member 194 constituting one of the improved features provided on the metering hopper 14. The separating and feeding member 194 is provided with a rubberized cap or pad **194*a*, as shown in FIGS. 12, 15 and 16, for increasing the coefficient of friction thereof and thereby promoting proper feeding engagement of the member 194** with the lowermost newspaper N throughout the feeding operation as will be subsequently explained.

The member 194 is pivotally connected to the support plate 180 by a four-bar linkage, broadly denoted by the numeral 196 and shown in FIGS. 12, 15, 16 and 18. The linkage 196 includes forward and rear pairs of mounts 198 on the upper face of the support plate 180 and the inboard sides of the rails 182, with forward and rear cross pivots 200, which form the lower pivot points of the four-bar linkage, extending between the respective pairs of mounts. Further, forward and rear tabs 202 depend below the separating and feeding member 194, and forward and rear parallel connecting links 204 fixed and extending between the corresponding cross pivots 200 and forward and rear cross pins are thereby pivotally connected to the corresponding mounts 198 and tabs 202, with the pins 206 forming the upper pivot points of the four-bar linkage 196 and the parallel connecting links 204 completing the linkage. Thus, the member 194 can swing between a lowered, retracted position as shown, for example, in FIGS. 11 and 15 and a raised, extended position as shown, for example, in FIGS. 12, 14, 16, and 17. From a comparison of FIGS. 11 and 14, it will be noted that when the separating and feeding member 194 is in its lowered position (FIG. 11), the top of its friction page 194*a* is disposed even with or just slightly above the rails 182, whereas in its raised position (FIG. 14), the top of pad 194*a* is disposed a greater distance above the rails.

Figure 15:
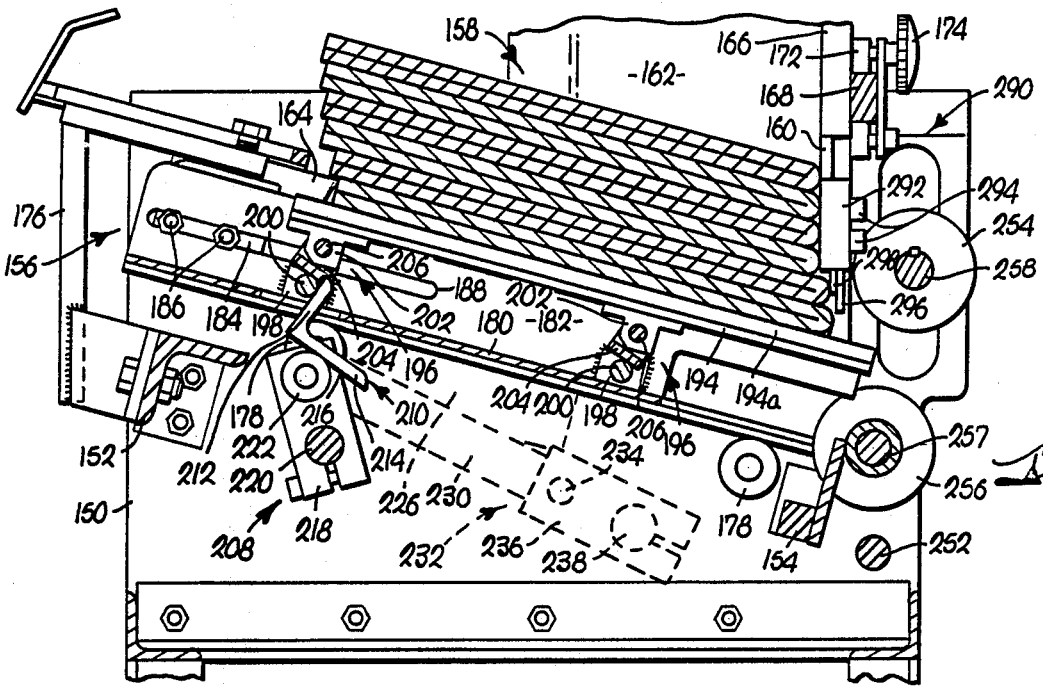
FIG. 15 is a fragmentary vertical, cross-sectional view of the hopper taken substantially along a fore-and-aft midline of the latter and showing the clamping rollers separated in their initial position as seen in FIGS. 10 and 11 and the reciprocable support structure prior to starting along its feed stroke to begin removal of the lowermost newspaper from the stack in the hopper.
Figure 12:
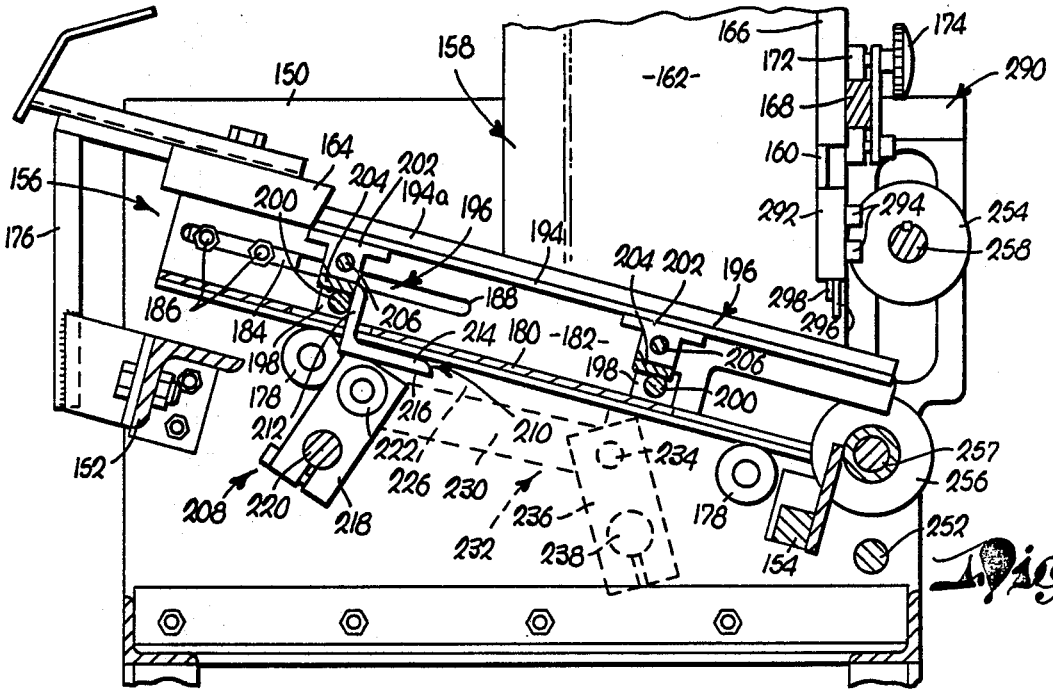
FIG. 12 is a fragmentary vertical, cross-sectional view of the hopper taken substantially along a fore-and-aft midline of the latter and showing the clamping rollers separated farther apart than in their initial position in FIGS. 10 and 11 and the reciprocable support structure started along its feed stroke to begin removal of the lowermost newspaper from the stack in the hopper.
Figure 16:
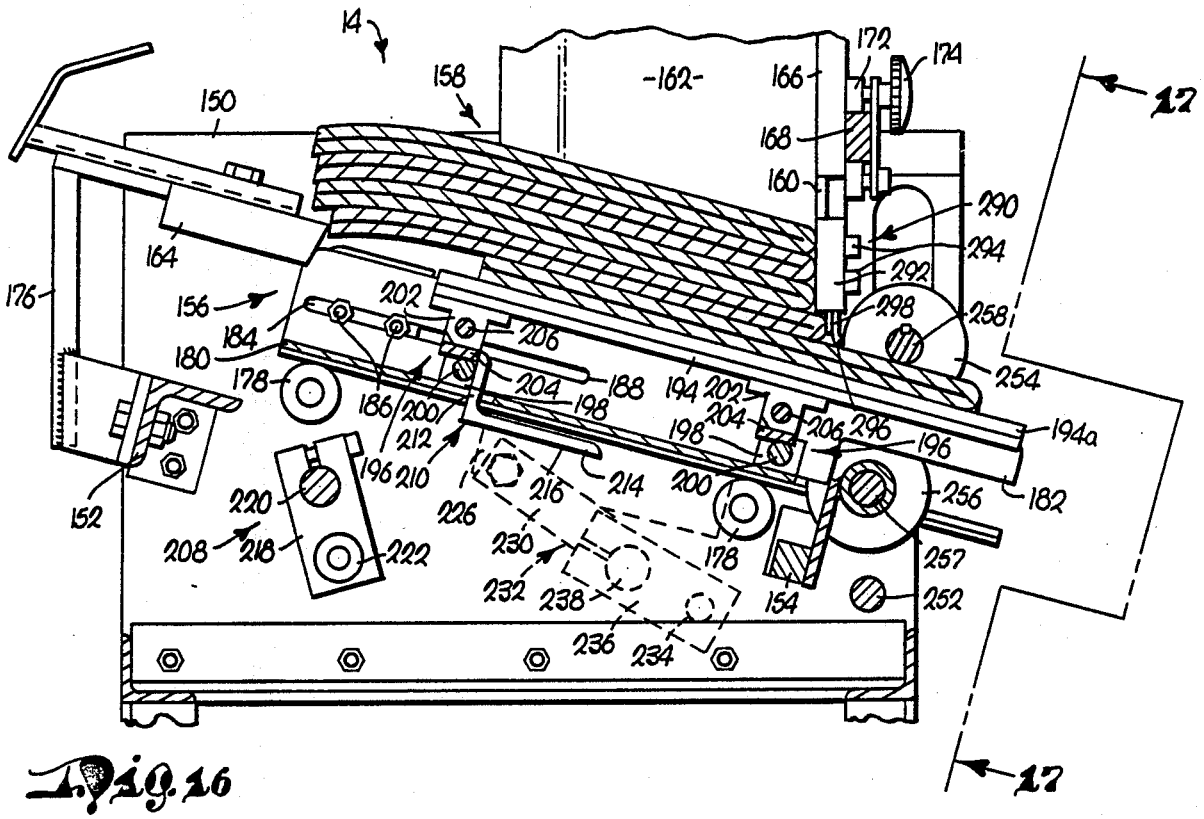
FIG. 16 is a view similar to FIG. 15 but showing, as seen in FIG. 14, the reciprocable support structure of the hopper as well as its upper and lower clamping rollers in their respective positions at ejection of the lowermost newspaper from the stack.

As illustrated clearly in FIGS. 12, 15 and 16, there is mechanism provided beneath the support plate 180 for shifting the separating and feeding member 194 to its raised position as the plate 180 commences each feed stroke. In this respect, such shifting mechanism, broadly designated as 208, includes an L-shaped cam arm 210 having generally vertical and horizontal arm portions 212 and 214. The vertical arm portion 212 is fixed to and depends below the rear connecting link 204 through an opening 180*a* in plate 180, whereas the horizontal arm portion 214 has an underside providing a cam surface 216. In the lowered position of the separating and feeding member 194, the connecting links 204 are tilted forwardly relative to the plane of the support plate 180 and the cam surface 216 of the cam arm 210 extends at an acute angle downwardly from the underside of the plate, whereas in the raised position of the member 194, the connecting links 204 extend generally perpendicular to the plate 180 and the cam surface 216 extends generally parallel to the plate.

The shifting mechanism 208 also includes an actuator arm 218 on a cross shaft 220 extending between and rotatably mounted by the side plates 150 of the hopper 14. The actuator arm 218 rotatably mounts a roller 222 on its outer end which is engagable with the cam surface 216 of the cam arm 210. As the actuator arm 218 and cross shaft 220 are rotated clockwise at initiation of the feed stroke of the device 156, the cam arm 210 is pivoted counterclockwise from its angled position of FIG. 15 to its parallel position of FIG. 12 relative to the support plate 180 by the roller 222 and thereby pivots the rear link 204 counterclockwise from its forward tilted position to its perpendicular position which raises the member 194 from its lowered, retracted position to its raised, extended position. Upon the return stroke of the device 156, due to friction of the member 194 with the overlying newspaper, it returns to its lowered position as the support plate 180 is moved rearwardly, with the cam arm 210 pivoting back to its angled position of FIG. 15.

Figure 14:
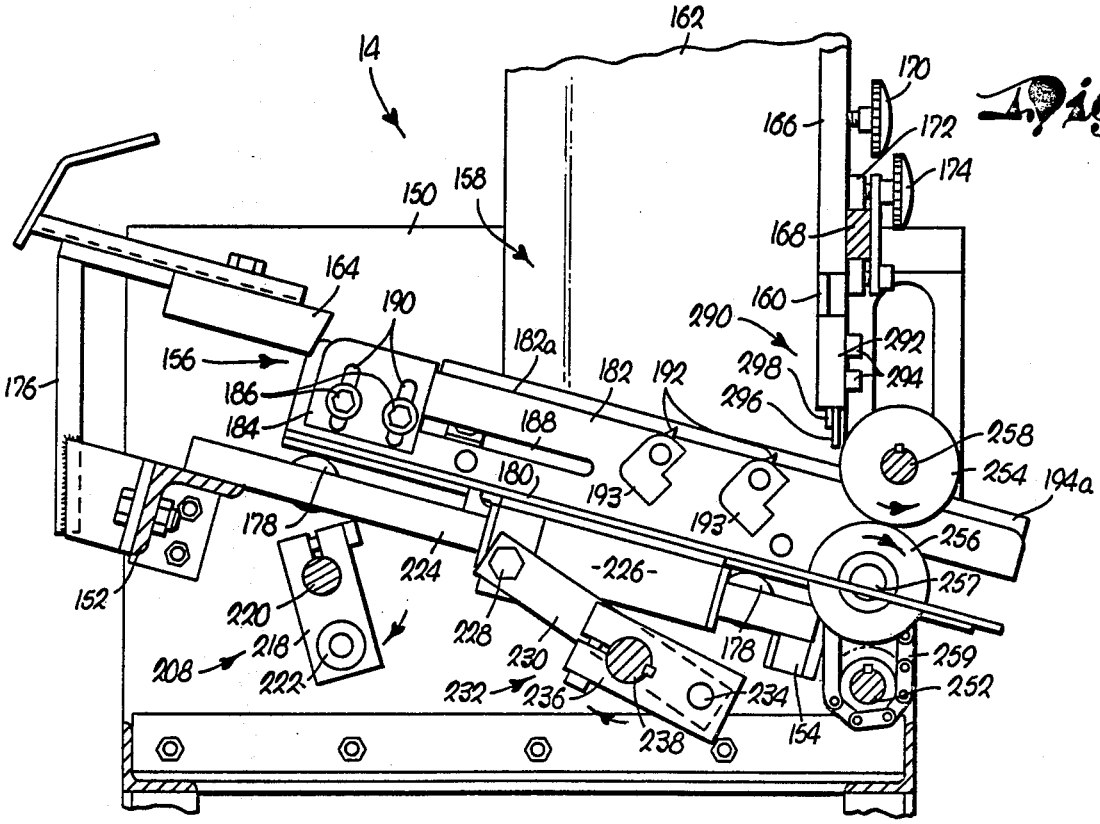
FIG. 14 is a side elevational view, partly in section, of the metering hopper of FIG. 13 as seen with its side plate, linkage and drive arrangement being omitted to expose the reciprocable support structure of the hopper as well as its upper and lower clamping rollers in their respective positions at ejection of the lowermost newspaper from the stack.

The support plate 180 of the feeder device 156 is guided in its reciprocation by a fore-and-aft extending, centrally disposed guide rod 224 (FIGS. 11 and 14) supported between the rear transverse angle beam 152 and the front transverse bar 154. A sleeve 226 fixed to the bottom of the support plate 180 is slidably received on the guide rod 224 and is connected via a pivot 228 to one end of a link 230 forming a part of a drive mechanism, generally designated 232, for the plate 180 and hence also for the feeder device 158 as a whole. The link 230 is also connected at its opposite end by a pivot 234 to a crank 236 clamped onto an input drive shaft 238, as seen in FIGS. 11 and 14, which is powered by a downwardly and forwardly extending drive chain 239 (FIGS. 10, 13, and 17) leading to a surce of power (not shown).

Figure 10:
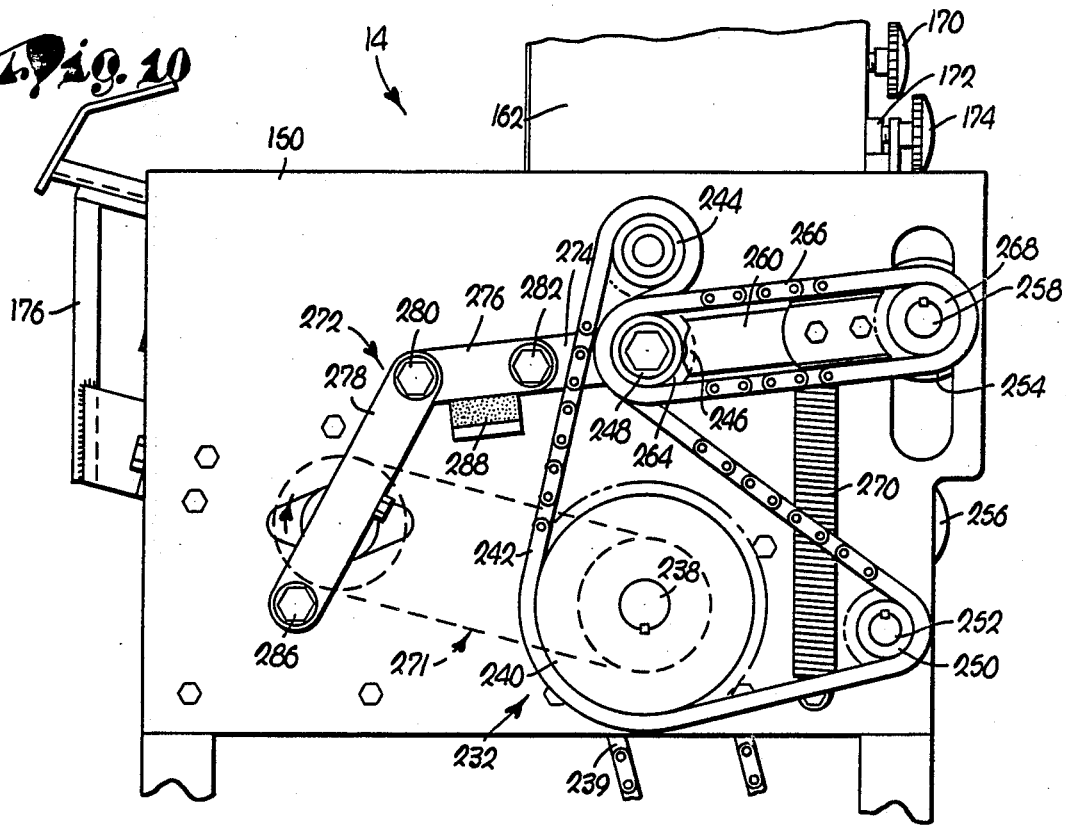
FIG. 10 is a fragmentary side elevational view of one of the metering hoppers of the assembling system of FIG. 1, showing a drive arrangement for rotatably driving upper and lower clamping rollers and showing the position of linkage holding the upper rollers in separated relationship from the lower ones just prior to the start of removal of the lowermost newspaper from a stack thereof in the hopper.
Figure 13:
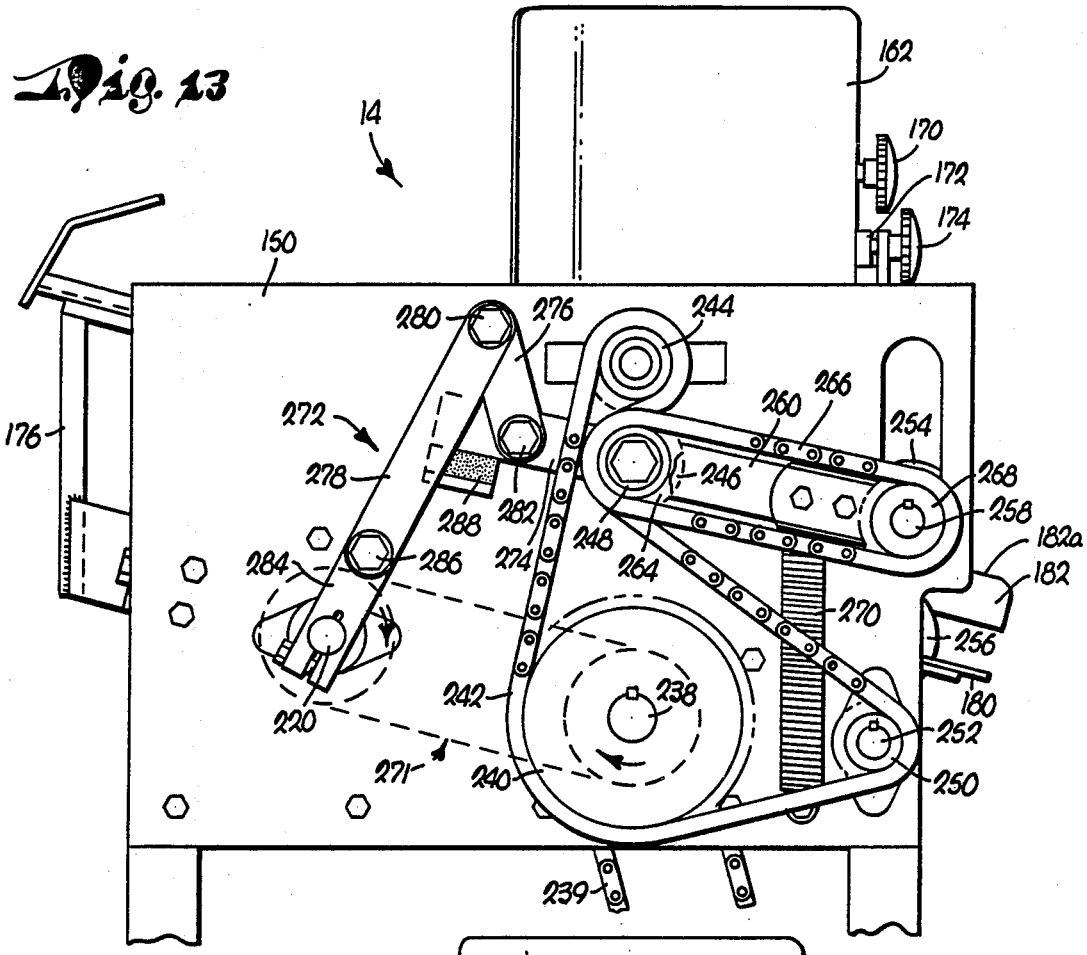
FIG. 13 is a view similar to that of FIG. 10, but showing the position of linkage allowing the upper rollers to assume a clamping relationship with the lower ones for engaging and ejecting the lowermost newspaper from the stack thereof in the hopper.
Figure 14:
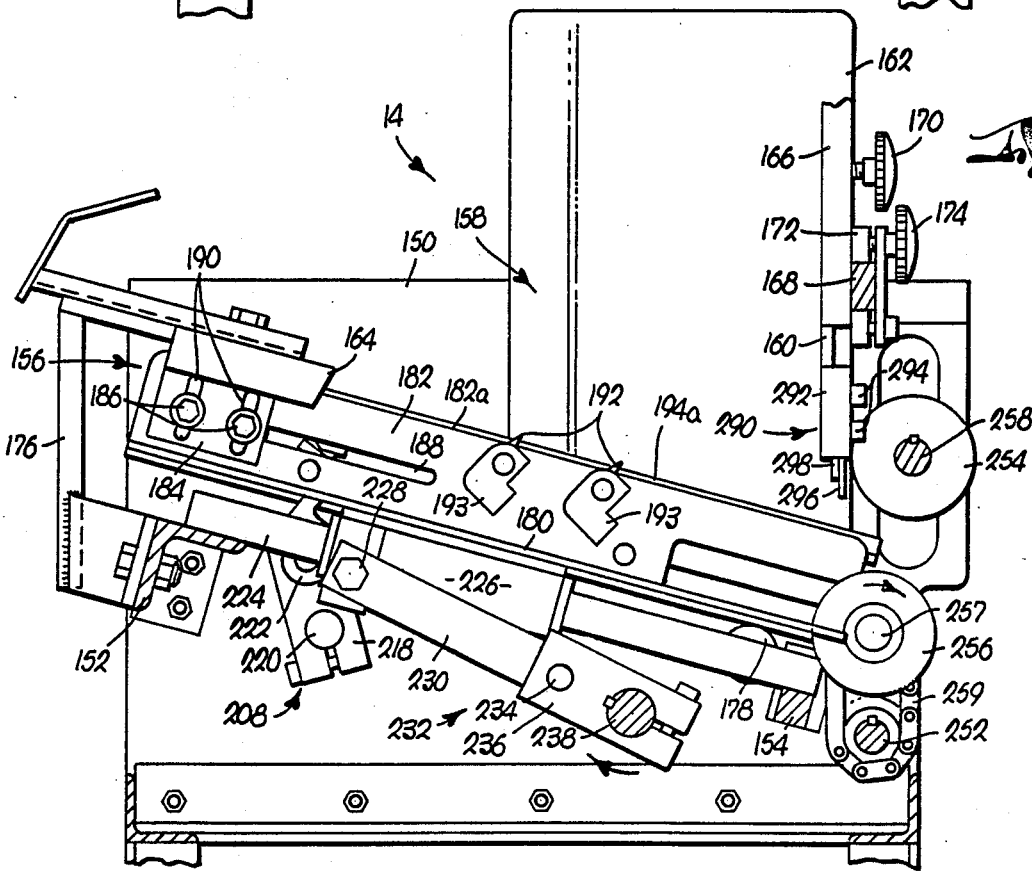

As further seen in FIGS. 10 and 13, the input drive shaft 238 projects outwardly through and beyond one of the side plates 150 (the left one in FIG. 17 and the lower one in FIG. 18) and on its outermost end carries a large sprocket 240 which delivers rotary power from the shaft 238 to an endless chain 242 partially entrained around the sprocket 240. Also, referring to FIGS. 17 and 18 in addition to FIGS. 10 and 13, the chain 242 is entrained about an upper idler sprocket 244 rotatably mounted to the one side plate 150, is back-wrapped around an intermediate idler sprocket 246 fixed on a stub shaft 248 journaled to the side plate 150 and then trained around a lower driven sprocket 250 adjacent the front of the hopper 14 which is carried by a shaft 252 which spans the side plates 150 and is journaled thereby.

Figure 17:
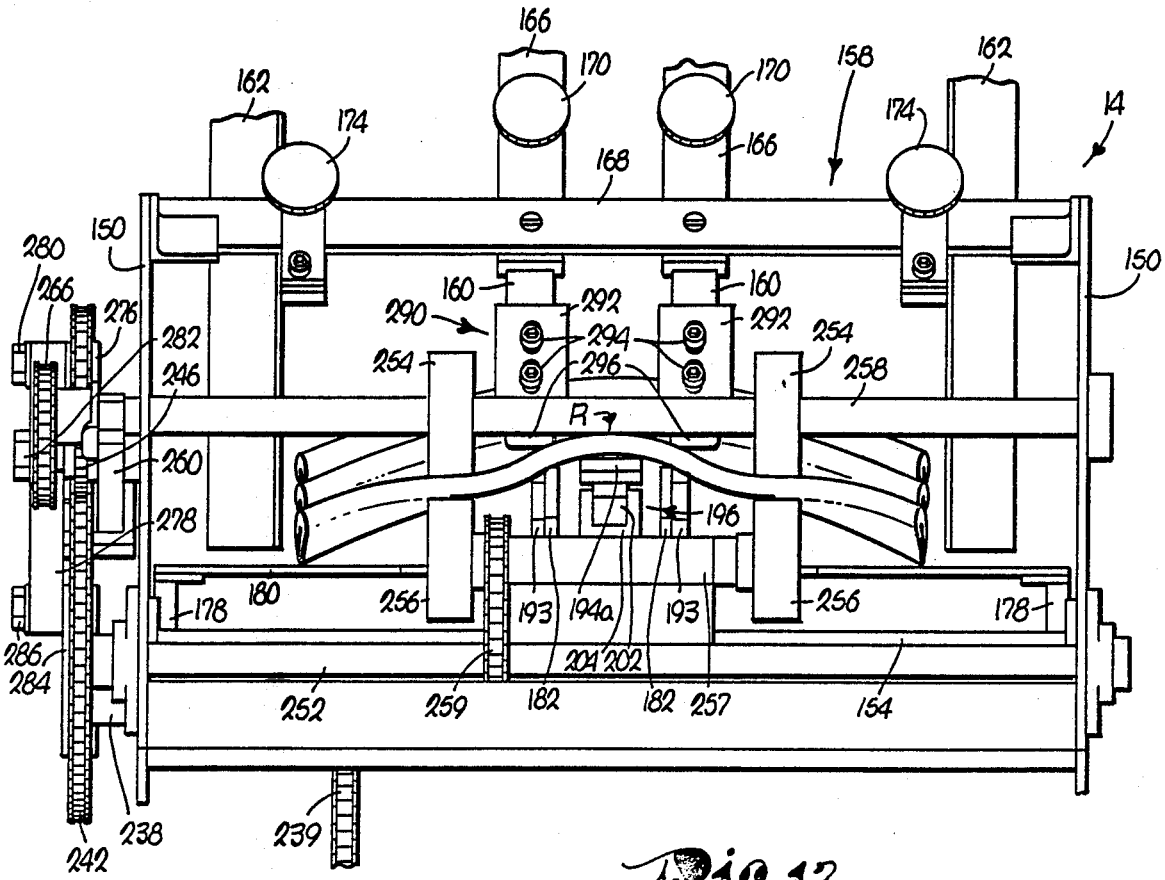
FIG. 17 is a fragmentary end elevational view of the hopper as seen along line 17—17 of FIG. 16.

Upper and lower pairs of clamping nip rollers 254 and 256, constituting another of the improved features, are provided at the front of the metering hopper 14. The pair of laterally spaced lower nip rollers 256 are carried by a shaft 257 outboard of the rails 182 and with their upper peripheries below the level of friction pad 194*a* on the separating and feeding member 194 even when it is in its retracted position, as seen in FIG. 15. As seen in FIG. 17, the shaft 257 is coupled by a chain 259 to the lower driven shaft 252. The pair of correspondingly spaced upper nip rollers 254 are aligned above the lower rollers 256 and carried by another driven shaft 258 which is journaled at its opposite ends to the forward ends of a pair of levers 260 disposed outboard of the side plates 150 of the hopper 14 and pivotally mounted intermediate their opposite ends respectively by the one stub shaft 248 and another stub shaft 262 (FIG. 18).

As seen in FIGS. 10 and 13, in addition to the intermediate idler sprocket 246, the one stub shaft 248 also carries a drive sprocket 264 being drivingly coupled by a chain 266 to a driven sprocket 268 on the one end of the upper roller driven shaft 258. In such manner, the drive sprocket 264 is rotatable about the pivot axis of the levers 260 so that rotary power is transmitted from the sprocket 264 to the sprocket 268 even as the levers 260 pivot the upper clamping rollers 254 toward and away from the stationarily-positioned lower clamping rollers 256. As indicated by the arrows in FIGS. 11 and 14, the upper clamping nip rollers 254 are driven in a counter-clockwise direction, while the lower rollers 256 are driven in a clockwise direction, with both pairs being driven at relatively high speeds. Also, tension springs 270 extending between the levers 260 and side plates 150 yieldably bias the levers and thereby the upper rollers 254 toward the lower rollers 256.

The upper clamping rollers 254 are moved toward and away from the lower clamping rollers 256 by the pivotal levers 260 in a timed relationship with the feed and return strokes of the support plate 180 of the feeder device 156. This is accomplished by a drive coupling 271 between input drive shafts 238 and the cross shaft 220 which carries the actuator arm 218, and by linkages, generally designated 272 in FIGS. 10, 13 and 18, which interconnect rear ends 274 of the levers 260 extending rearwardly of the stub shafts 248 and 262 with the opposite ends of the cross shaft 220 which carries the actuator arm 218 for pivoting the cam arm 210. Particularly, the linkage 272 includes a short upper link 276 and a long lower link 278 pivotally connected together by fastener 280 and respectively pivotally connected to the one lever end 274 by a fastener 282 and to the outer end of a crank arm 284 on each opposite end of the cross shaft 220 by a fastener 286. A stop 288 on each rear end 274 of the levers 260 limits pivoting of the short link 276 relative to the lever to the aligned position shown in FIG. 10.

During each revolution of the input drive shaft 238, its crank 236 via link 230 and sleeve 226 moves the support plate 280 through one complete cycle of feed and return strokes. Concurrently, during each revolution of the input drive shaft 238, the cross shaft 220 also makes a revolution and its actuator arms 218 and crank arms 284 move through one complete cyle of revolution. The actuator arm 218 pivots the cam arm 210 upward so as to raise the member 194 to its extended position as the plate 180 starts forwardly on its feed stroke, as seen in FIG. 12. Once the feed stroke has started and the member 194 has been raised to the FIG. 12 position, the crank arms 284 (one of which is hidden in FIG. 10 behind the long link 278) have reached the angular position shown in FIG. 10 in which they are holding the levers 270 at their maximum counterclockwise pivotal displacement which causes separation of the upper clamping rollers 254 by the maximum allowable distance from the lower rollers 256. As the support plate 180 nears the end of its feed stroke, which is depicted in FIGS. 14, 16 and 17, the crank arms 284 have rotated 180 degrees to the position shown in FIG. 13 which allows the levers 260 to be moved to their maximum clockwise pivotal displacement by contraction of the tension springs 270. It will be observed that the upper clamping rollers 254 remain separated from the lower clamping rollers 256 until the leading portion L of the lowermost newspaper N has been inserted between the rollers. Thus, no gripping of the newspaper takes place until it is positioned between the rollers. Then, the upper rollers 254 snap down against the lower rollers 256, clamping the inserted leading newspaper portion L in the nip formed therebetween.

As seen in FIGS. 11 and 17, the clamping nip is formed at a level below that of the friction pad 194*a* on the separating and feeding member 194. It is also seen that the clamping rollers 254 and 256 are aligned generally with the valley areas on opposite sides of the central ridge R in the newspaper. Consequently, as the upper rollers 254 abruptly close down against the lower rollers 256, they snap the valley areas of the newspaper down with them and further exaggerate the central ridge R to enhance the separating action. As shown in FIG. 17, this tends to leave only the central ridge R of the lower paper engaging the next paper thereabove, not only at the leading edge of the paper but also for its full fore-and-aft length and its side-to-side width. Consequently, frictional contact between the lower paper and the next one thereabove is maintained only along the ridge R, which significantly reduces resistance to withdrawal of the lower paper. With the extent of frictional contact reduced by virtue of the ridging effect, the quick, clean jerk of the lowermost paper out of the stack by the high-speed rollers 254, 256 completes the withdrawal action with significantly reduced tendency for the next newspaper to follow along or otherwise inhibit withdrawal of the lowermost paper.

Additionally, the metering hopper 14 is provided with a pair of inverse stairstep-like stop devices 290 (detailed in FIGS. 20, 21, 22) for confining all but the lowermost newspaper from moving forward with each feed stroke of the support plate 180 of the feeder device 156, the stop devices constituting still other improved features provided on the hopper 14. Each stop device 290 is adjustably mounted to one of the front retainers 160 on the front side thereof by a bracket 292 and setscrews 294, and each also includes a pair of downwardly projecting fingers 296 and 298 arranged in an inverse stair-stepped relationship with one another and with the retainer 160. The lower front finger 296 is resiliently flexible and is displaced above the upper surfaces 182*a* of the support rails 182 a sufficient distance to allow passage of the lowermost newspaper thereunder. The next finger 298 is disposed rearwardly of the finger 296 and higher up from the rails 182 and in the path of the one newspaper immediately above the lowermost one. The lower finger 296 has a vertical slot 300 defined therein for passage of the setscrews 294 and for adjusting it vertically relative to the rails 182. The front retainer 160 stops the rest of the newspapers in the stack.

OPERATION

Broadly speaking, each interfaced loader 12 and hopper 14 of the system 10 receives successive stacks of newspapers or parts thereof and meters them one at a time onto a cross conveyor 16 in a desired sequence coordinated with the newspapers or parts thereof from the other interfaced loaders and hoppers. In particular, the newspaper flow starts at the receiving region of the transfer path defined on each loader 12 when a stack of newspapers is placed astradle a parallel arrangement of side conveyors 36 and a central conveyor 38. The newspapers in the stack are manually fanned back into a stream as shown in FIG. 6, a procedure which is made easier and more problem-free by the ridges R produced in the newspapers N due to the elevated position of the central conveyor 38 above the side conveyors 36. The ridged newspapers are stiffened to prevent roll-up of their leading foldline, and their slick advertising inserts are locked in place as the papers slide relative to one another in the fanning process.

As the newspapers in the stream thereof reach the discharge region of the loader transfer path, coaction between superimposed center conveyors 112 and inclined arms 114 on the loader 12 again produces central ridges in the newspapers immediately before they are ejected one at a time by the conveyors 112, as seen in FIG. 9, into a vertical receiving or loading zone 158 of the one metering hopper 14 interfaced with the particular loader 12. Here again, the central ridge benefits by making the flimsy newspaper jut out stiffly during ejection until it is aligned vertically with the awaiting hopper, whereupon it is released by the loader and dropped in a flat condition into the hopper.

A stack of newspapers becomes formed in the zone 158 above and supported upon the reciprocating feeder device 156 of the metering hopper 14. As the support plate 150 of the feeder device 156 reciprocates across the bottom of the hopper 14, the single separating and feeding member 194, disposed between the pair of rails 182 which support the lowermost newspaper, rises on the feed stroke and retracts on the return stroke of the plate 150. When the member 194 is raised, it lifts the newspaper above the rails 182 and produces an elongated central ridge in each of the newspapers (FIG. 17), but which is most pronounced in the lowermost one. The ridge causes separation between the newspapers.

On the feed stroke, the lowermost newspaper slides relative to the rest of the stack under the finger 296 of the stairstep stop device 290 (FIGS. 20 and 21), and its leading portion L is presented between the normally separated clamping rollers 254 and 256, which then snap closed against the leading edge to exaggerate the ridge, bend the leading edge downwardly away from the next newspaper above it, and quickly jerk the lowermost paper out of the stack. The separating member 194 then automatically retracts during the return stroke of the support plate 180 due to friction with the next overhead newspaper.

The inverse stairstepped stop devices 290 provide significant assistance in clean separation and withdrawal of the lowermost newspaper from the rest of the stack. In this respect, the frontmost finger 296 of each stop device 290 should be set at such a position as to provide unrestricted clearance for the lowermost newspaper therebeneath during the withdrawal action. Likewise, the second finger 298 preferably should be offset vertically from the front finger 296 by a distance which is at least as great as the thickness of the newspapers being dispensed so that the next-to-lowest newspaper in the stack has its leading edge abutted against the backside of the front finger 296. Likewise, the vertical distance between the lowermost extremity of the finger 298 and the lowermost extremity of the front retainer 160 should be the same as or slightly greater than the thickness of the newspapers such that the third newspaper in the stack may have its leading edge abut the backside of the finger 298. The remaining newspapers in the stack will be abutted against the backside of the front retainer 160 and in vertical alignment with one another.

This inverse stairstep arrangement for the stop devices 290 causes the leading edges of the first few lower newspapers to be set back from one another in a corresponding stairstepped manner which has the effect of relieving the weight of overhead newspapers from such leading edges. Thus, as the lower paper is pulled outwardly and downwardly by the high-speed nip rollers 254, 256, any remaining frictional contact between the lower paper and the next paper thereabove has a tendency to pull the outer jacket of the next paper forwardly against the backside of finger 296 and cause the paper to curl upwardly in the manner illustrated in FIG. 21 into the open area beneath the next finger 298. Giving the leading edge of the next paper the opportunity to curl upwardly and forwardly in this manner is quite significant inasmuch as it avoids the tendency for such leading edge to be driven and forced downwardly under the finger 296 simultaneously with the lowermost paper.

The resiliency of the finger 296 is significant in helping to avoid jamming of the mechanism in the event that one of the newspapers being dispensed has accidentally been provided with an excessive number of inserts and thus is oversized relative to the remainder of the newspapers in the hopper. In such instance, as illustrated in FIG. 22, the finger 296 flexes to the extent necessary to pass the oversize paper when it reaches the lowermost position in the stack and is withdrawn.

It is thought that the present invention and many of its attendant advantages will be understood from the foregoing description, and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. In an apparatus for handling a plurality of normally flat, multi-section, floppy newspapers each having a folded outer section with a transverse fold line along one extremity of said newspaper and a plurality of inner sections being tucked within said outer section, an improved metering hopper comprising:

(a) a support structure adapted to receive newspapers and support the same in a stack thereof in an upright receiving zone having a pair of opposite lateral extremities and disposed above said structure, said structure being reciprocable transversely of the zone along a feeding path in successive feed and return strokes;

(b) means for confining all but the lowermost newspaper in the stack thereof against movement with the said support structure during said feed stroke;

(c) a separator being coupled to said support structure and disposed below said lowermost newspaper inwardly from said lateral extremities of said zone and movable between a raised position, upon said feed stroke of said support structure, whereupon it engages said lowermost newspaper so as to form at least one elongated ridge therein which extends from said fold line to an opposite extremity of said newspaper and thereby causes separation of said lowermost newspaper from the one above it, and a retracted position, upon said return stroke of said support structure, whereupon it releases from said lowermost newspaper;

(d) upper and lower driven roller means disposed along said feeding path of said support structure for engaging and ejecting said lowermost newspaper from said stack thereof; and (e) operating mechanism coupled with said roller means for normally displacing said roller means from one another in a separated relationship for receiving a leading portion of said lowermost newspaper therebetween without gripping said leading portion, (f) said operating mechanism being operable to move said roller means relative to one another into a clamping relationship in which a gripping nip is defined therebetween, (g) said lower roller means being disposed below said separator and spaced laterally therefrom whereby to correspondingly dispose said nip below the separator when the roller means are clamped together, thereby augmenting separation of said lowermost newspaper from one above it to cause ejection of said lowermost newspaper from said stack.

2. An apparatus for handling newspapers as claimed in claim 1, wherein said confining means includes a plurality of downwardly extending stops positioned one in front of the other with respect to the direction of newspaper feed, said stops having lowermost extremities disposed in stairstepped relationship to one another with the extremity of the forwardmost stop being lowest with respect to the other extremities of the stops, said forwardmost stop having its lowermost extremity positioned to permit movement therebeneath of only the lowermost newspaper with said support during the feed stroke, and the other rearwardly successive stops of said plurality being progressively raised relative to one another as to permit proximal newspapers in the stack abutting the stops to correspondingly present their leading edges in stairstepped relationship to one another.

3. An apparatus for handling newspapers as claimed in claim 2, wherein said lowermost extremity of at least the forwardmost stop is resilient to permit yielding passage therebeneath of oversized newspapers.

4. An apparatus for handling newspapers as claimed in claim 2, wherein said separator is a single elongated member disposed for engaging said lowermost newspaper from beneath the same and forming said ridge along the center thereof when said single member is raised upon said feed stroke of said support.

5. An apparatus for handling newspapers as claimed in claim 4, wherein said upper and lower driven roller means includes a pair of upper and lower rollers disposed on opposite lateral sides of said single elongated separator member, each pair capable of forming a gripping nip spaced below the level of said separator member.

6. An apparatus for handling newspapers as claimed in claim 2, wherein said confining means includes two sets of said plurality of stops at two spaced positions along the front of said zone, said separator being a single elongated generally flat member disposed between and below said stops for engaging said lowermost newspaper from beneath the same and forming said ridge along the center when said single member is raised upon said feed stroke of said support.

7. In a method of handling a plurality of normally flat, multi-section, floppy newspapers each having a folded outer section with a transverse fold line along one extremity of said newspaper and a plurality of inner sections being tucked within said outer section, an improved method of metering newspapers from a stack thereof comprising the steps of:

(a) supporting newspapers in an upright stack thereof;

(b) confining all but the lowermost newspaper in the stack thereof against movement transversely of the stack along a feeding path for removal from said stack;

(c) moving said lowermost newspaper along said feeding path and concurrently forming at least one elongated ridge therein which extends from said fold line to an opposite extremity of said newspaper and thereby causes separation of said lowermost newspaper from the one above it; and (d) engaging said lowermost newspaper in a clamping relationship at locations spaced rearwardly of a leading portion thereof, laterally of said elongated ridge formed therein and below the ridge for augmenting separation of said lowermost newspaper from one above it and causing ejection of said lowermost newspaper from said stack.

8. In a method of handling newspapers as claimed in claim 7, wherein said engaging step includes disposing upper and lower driven rollers in a separated relationship in which said rollers are displaced from one another for receiving said leading portion of said lowermost newspaper therebetween without gripping the same, and then moving said rollers relative to one another into a clamping relationship in which said rollers form a nip for gripping said leading newspaper portion after receipt of said leading portion therebetween.

9. In a method of handling newspapers as claimed in claim 7, wherein said ridge-forming step is carried out by engaging said lowermost newspaper from beneath by a single elongated member and slightly raising said member relative to said stack of newspapers.

* * * * *